United States Patent [19]

Hart

[11] Patent Number: 4,807,555

[45] Date of Patent: Feb. 28, 1989

[54] RIGIDIFIER FOR AN INFLATABLE BOAT

[75] Inventor: John T. Hart, Ladue, Mo.

[73] Assignee: H & H Sales Corporation, Clayton, Mo.

[21] Appl. No.: 11,269

[22] Filed: Feb. 5, 1987

[51] Int. Cl.[4] ..... B63B 7/08

[52] U.S. Cl. ..... 114/345; 114/354; 441/40

[58] Field of Search ..... 114/345, 343, 352–354, 114/357, 364, 63; 441/40

[56] References Cited

U.S. PATENT DOCUMENTS

| | | | |
|---|---|---|---|
| 671,502 | 4/1901 | Sultemeyer | 114/345 |
| 1,333,109 | 3/1920 | Ford | 114/345 |
| 1,555,080 | 12/1924 | Scheibert | 114/345 |
| 2,600,757 | 6/1952 | Grimston | 114/345 |
| 2,876,467 | 10/1955 | Lund | 114/345 |
| 2,880,429 | 4/1959 | Henry | 114/354 |
| 2,949,616 | 8/1960 | Desanges | 114/345 |
| 2,999,253 | 9/1961 | Lewis | 114/345 |
| 3,170,174 | 9/1961 | Hanel | 114/345 |
| 3,566,425 | 3/1971 | Welty | 114/345 |
| 3,748,671 | 7/1973 | Dusmet | 114/345 |
| 4,057,865 | 11/1977 | Trautwein | 114/345 |
| 4,063,320 | 12/1977 | Neumann | 114/345 |
| 4,231,131 | 11/1980 | Young | 114/345 |
| 4,251,893 | 2/1981 | McCrory | 114/345 |
| 4,603,651 | 8/1986 | Harding | 114/345 |

FOREIGN PATENT DOCUMENTS 2051834 10/1972 Fed. Rep. of Germany .

*Primary Examiner*—Sherman D. Basinger
*Assistant Examiner*—Clifford T. Bartz
*Attorney, Agent, or Firm*—Senniger, Powers, Leavitt and Roedel

[57] ABSTRACT

A rigidifier for an inflatable boat of the type having a flexible floor and an inflatable tubular portion around the periphery of the floor forming a cockpit. The rigidifier comprises a floorboard member removable from and receivable in the cockpit to overlay the floor. The member is rigid in one direction to provide rigidity to the floor and collapsible in another direction so that it may be rolled up after being removed from the cockpit. The rigidifier further comprises a framework adapted for detachable connection to the floorboard member to provide rigidity to the floorboard member in another direction so that rigidity is provided to the floor of the boat in substantially all directions.

11 Claims, 2 Drawing Sheets

RIGIDIFIER FOR AN INFLATABLE BOAT

BACKGROUND OF THE INVENTION

This invention relates generally to inflatable boats, and more particularly to a rigidifier for the floor of such a boat.

The burden of transporting recreational boats has become more oppressive in recent years, partly because people are increasingly purchasing small, fuel efficient cars, in lieu of large cars capable of carrying and pulling heavy loads. In addition, it has long been difficult to transport boats to remote locations, which frequently are the most desirable for fishing or scuba diving. One approach to this problem would be to use inflatable boats for such recreational activities as fishing, scuba diving or the like, since such boats are readily deflated and collapsed for transport and storage. However, inflatable boats have typically been impractical for such uses, because such boats have not been sufficiently rigid to be driven by the outboard motors necessary to reach remote areas. In addition, the floors of inflatable boats are generally incapable of withstanding the load required for scuba diving, for example.

SUMMARY OF THE INVENTION

Among the several objects of the invention may be noted the provision of a rigidifier for an inflatable boat, particularly for providing rigidity to the floor of such a boat, thereby adapting the boat for use by scuba divers, fishers and the like and adapting the boat to be driven by a motor; the provision of such a rigidifier which is adapted to rigidify the floor of the boat in substantially all directions; the provision of such a rigidifier which is adapted to be rolled up after being removed from the cockpit of the boat for storage and/or for transport; the provision of such a rigidifier which is adapted to be rolled around an outboard motor after being removed from the cockpit of the boat so that the motor and rigidifier may be inserted into a bag for carrying; the provision of such a rigidifier which is light-weight and durable; the provision of such a rigidifier which is inexpensive to manufacture and easy to use; and the provision of a combination of such a rigidifier and an inflatable boat in a kit.

Generally, a rigidifier of the present invention is used to rigidify an inflatable boat of the type having a flexible floor and an inflatable tubular portion around the periphery of the floor forming a cockpit. The rigidifier comprises a floorboard member removable from and receivable in the cockpit to overly the floor. The member is rigid in one direction to provide rigidity to the floor and collapsible in another direction so that it may be rolled up after being removed from the cockpit. The rigidifier further comprises a framework adapted for detachable connection to the floorboard member to provide rigidity to the floorboard member in another direction so that rigidity is provided to the floor of the boat in substantially all directions.

In a second aspect of this invention, an inflatable boat is provided in combination with the aforesaid rigidifier.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
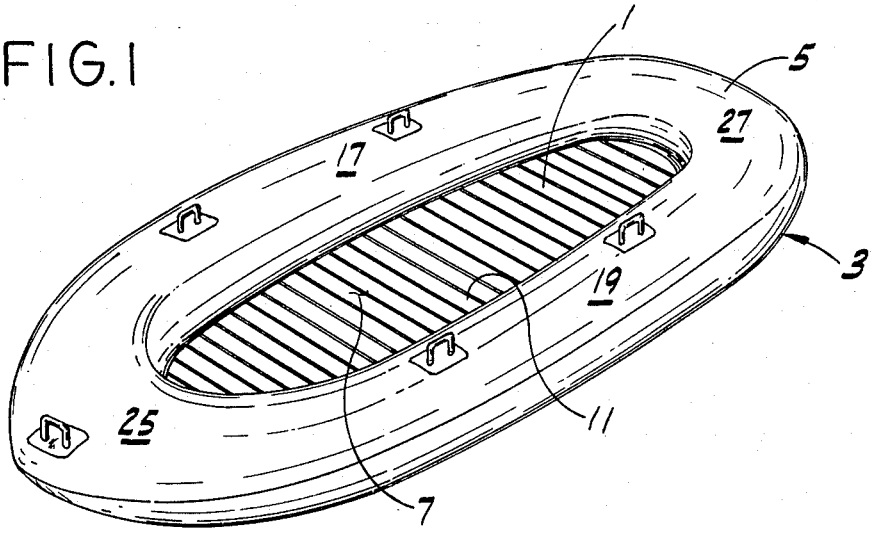
FIG. 1 is a perspective view of an inflatable boat having a rigidifier of the present invention placed therein.

Referring now to the drawings, a rigidifier of the present invention is designated in its entirety by the reference numeral 1. As illustrated in FIG. 1, the rigidifier 1 is particularly adapted to provide rigidity to an inflatable boat generally designated 3 of the type having a flexible floor (not shown) and an inflatable tubular portion 5 around the periphery of the floor forming a cockpit 7. While boat 3 may be used for fishing, scuba diving, or as a lifeboat, it is particularly contemplated that it will be used where a rigid floor is necessary, such as when scuba diving. It is further contemplated that the boat 3 will be driven by an outboard motor (.e.g., outboard motor 9 shown in FIG. 5).

Figure 2:
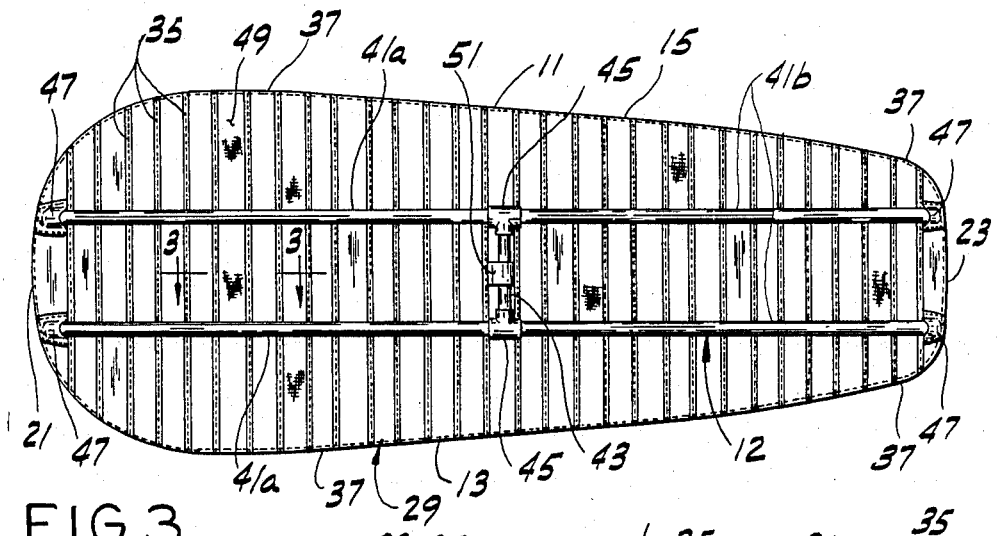
FIG. 2 is a bottom plan view of the rigidifier of FIG. 1.
Figure 3:
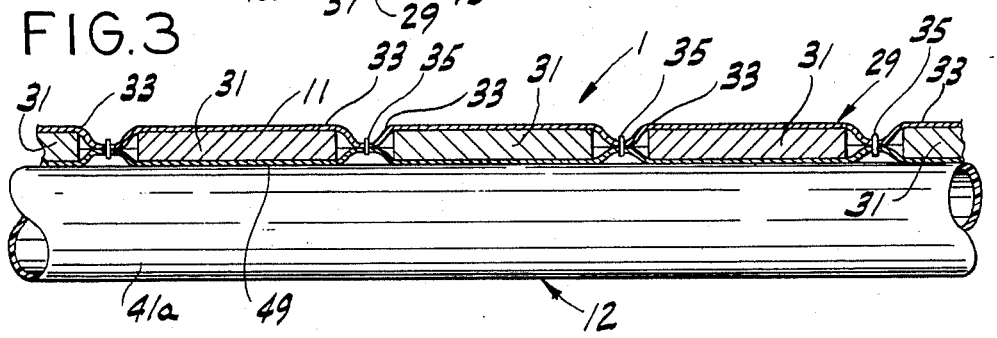
FIG. 3 is an enlarged cross-sectional view along line 3—3 of FIG. 2.
Figure 4:
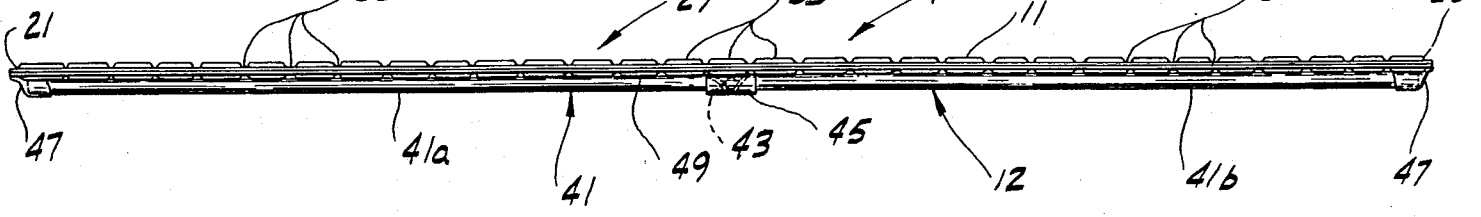
FIG. 4 is a side view of the rigidifier of FIGS. 1–3.

As shown in FIGS. 2–4, the rigidifier 1 comprises a floorboard member 11 and framework generally indicated at 12. The floorboard member 11 is removable from and receivable in the cockpit 7 to overlay the floor of the inflatable boat. It has opposite sides 13 and 15 adapted to be positioned generally adjacent the sides 17 and 19, respectively, of the boat and opposite ends 21 and 23 adapted to be positioned adjacent the bow 25 and stern 27, respectively, of the boat.

As shown in FIG. 3, the floorboard member 11 preferably comprises a fabric (e.g., nylon) sheath generally designated 29 and a multiplicity of generally parallel ribs 31 extending in side-to-side direction with respect to the floorboard. The ribs 31 are of any suitable substantially rigid material, such as wood, and each rib may be, for example, in the form of a slot roughly one-quarter of an inch (6 mm) thick and from one to two inches (25–51 mm) wide. A plurality of pockets 33 for receiving the ribs 31 are formed in the sheath 29 (e.g., by stitching 35) at closely spaced intervals in fore-and-aft direction with respect to the floorboard. The ends of the pockets 33 are closed by stitching 37 around the periphery of the floorboard member 11. The stitching 35 extends transversely of the floorboard member 1 between the ribs or slats 31 and function as hinge lines for permitting pivotal movement of the ribs relative to one another to enable the floorboard member to be rolled up.

It will be observed that, since ribs 31 extend in side-to-side direction, the floorboard member 11 is rigid in side-to-side direction and collapsible in fore-and-aft direction. It will be understood that the ribs may extend in fore-and-aft direction to provide rigidity in that direction. However, since the cockpit 7 and floorboard member 11 are typically longer in the fore-and-aft direction than in side-to-side direction, the floorboard member is preferably rigid in the side-to-side direction and collapsible in the fore-and-aft direction so that it occupies a minimum of space when rolled up.

When assembled with the floorboard member 11 (FIG. 2), the framework 12 extends along the floorboard member in fore-and-aft direction to rigidify the floorboard member in the fore-and-aft direction. The framework 12 preferably comprises two elongate generally parallel poles 41 (e.g., pipe or tube sections), each of which comprises two separate parts 41*a*, 41*b*, and a cross member 43 interconnecting the parallel members. One end of parts 41*a*, 41*b* are slideably receivable in T-fittings 45 at the ends of the cross member, and the other ends of the parts 41*a*, 41*b* are removably receivable in the openings or sockets 47 at the ends 21 and 23 and along the bottom side 49 of the floorboard member 11. The length of the assembled framework 12 should be sufficient to hold the floorboard member 11 in tension. A flexible loop 51 is secured to the floorboard member 11 for receiving the cross member 43 and holding the floorboard member adjacent to the cross member.

It will be observed that the framework 12 provides rigidity to the floorboard member 11 in a direction generally perpendicular to the ribs 31 so that rigidity is provided to the floor of the boat in substantially all directions.

Figure 5:
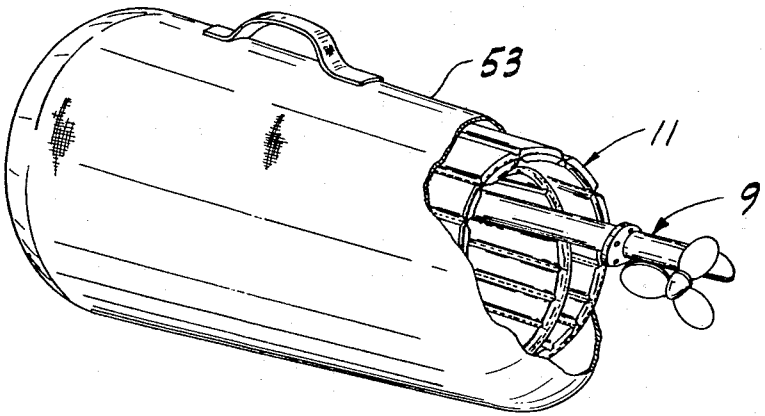
FIG. 5 is a perspective view of a carrying bag, partially broken away, for an outboard motor and the rigidifier of FIGS. 1–4.

In addition, it will be observed from the foregoing that the framework 12 is readily detachable from and connectable to the floorboard member 11. To assemble the framework, the cross member 43 is placed inside the loop 51, and one end of each elongate member part 41*a*, 41*b* is inserted into a respective T-fittings 45. The other end of each elongate member part 41*a* is then inserted in a respective socket 47 at one end of the floorboard member 11, and the floorboard member is stretched out along the framework 12 so that the far ends of the elongate member parts 41*b* can be inserted into respective sockets at the other end of the floorboard member. The rigidifier 1 may then be placed in the cockpit 7 of the boat 3, preferably before the boat is inflated. The rigidifier is disassembled in a similar manner; first, one end of the floorboard member 11 is pulled outwardly so that the sockets 47 are pulled free of the ends of the elongate members 41. After detaching the framework 12, the floorboard member 11 may be rolled fore-to-aft or aft-to-fore circumferentially around the outboard motor 9 to protect the motor. As shown in FIG. 5, the floorboard member 11 and outboard motor 9 may be inserted into a container or carry bag 53 for easy transport and storage. The inflatable boat 3, elongate members 41 and cross member 43 may then be inserted into another container (not shown) similar to container 53. A pump (not shown) for inflating the boat and other miscellaneous equipment may also be placed in the containers.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is;

1. A rigidifier for an inflatable boat of the type having a flexible floor and an inflatable tubular portion around the periphery of the floor forming a cockpit, said rigidifier comprising a floorboard member removable from and receivable in said cockpit to overlay said floor, said floorboard member having opposite sides and opposite ends and comprising a multiplicity of substantially rigid generally parallel relatively long narrow slats extending in side-to-side direction with respect to the floorboard member at relatively closely spaced intervals from substantially one end of the floorboard member to the other, said slats being flexibly interconnected for permitting the floorboard member to be rolled up after it is removed from the cockpit, and a collapsible framework adapted for detachable connection to said floorboard member to provide rigidity to the floorboard member in end-to-end direction, said framework comprising a pair of collapsible poles adapted to extend lengthwise of the floorboard member on the underside of the member, and means for detachably connecting said poles to the floorboard member.

2. A rigidifier as set forth in claim 1 wherein said poles are adapted to be connected to the floorboard member in a position wherein the poles are spaced inward from the sides of the floorboard member.

3. A rigidifier as set forth in claim 1 wherein said framework further comprises a cross member interconnecting said poles generally centrally of the floorboard member.

4. A rigidifier as set forth in claim 3 further comprising a flexible loop secured to said floorboard member for receiving said cross member and holding the floorboard member adjacent to said cross member.

5. A rigidifier as set forth in claim 3 wherein said floorboard member has a plurality of sockets on its underside for receiving the ends of said poles.

6. A rigidifier as set forth in claim 1 wherein said floorboard member comprises a flexible fabric sheath having a multiplicity of relatively narrow pockets extending in side-to-side direction with respect to the floorboard member and receiving said slats therein.

7. A rigidifier as set forth in claim 6 wherein said pockets are formed by lines of stitching extending transversely of the floorboard member between said slats, said lines of stitching constituting hinge lines for permitting pivotal movement of the slats relative to one another to enable the floorboard member to be rolled up.

8. A rigidifier as set forth in claim 1 in combination with a carrybag sized for holding said floorboard member when it is rolled up.

9. A rigidifier system for an inflatable boat of the type having a flexible floor and an inflatable tubular portion around the periphery of the floor forming a cockpit, said system comprising a rigidifier including a floorboard member removable from and receivable in the cockpit to overlay the floor, said floorboard member having opposite sides and opposite ends and comprising a multiplicity of substantially rigid generally parallel relatively long narrow slats extending in side-to-side direction with respect to the floorboard member at relatively closely spaced intervals from substantially one end of the floorboard member to the other, said slats being flexibly interconnected for permitting the floorboard member to be rolled up after it is removed from the cockpit, and a collapsible framework adapted for detachable connection to said floorboard member to provide rigidity to the floorboard member in end-to-end direction, said framework comprising a pair of collapsible poles adapted to extend lengthwise of the floorboard member on the underside of the member, means for detachably connecting said poles to the floorboard member, and a carrybag for carrying the rigidifier and said framework, said carrybag being sized to hold said rigidifier when it is rolled up and said framework when it is collapsed.

10. A rigidifier system as set forth in claim 9 wherein said floorboard member comprises a flexible fabric sheath having a multiplicity of relatively narrow pockets extending in side-to-side direction with respect to the floorboard member and receiving said slats therein.

11. A rigidifier system as set forth in claim 10 wherein said pockets are formed by lines of stitching extending transversely of the floorboard member between said slats, said lines of stitching constituting hinge lines for permitting pivotal movement of the slats relative to one another to enable the floorboard member to be rolled up.

* * * * *